US005293962A

United States Patent [19]

Pelvilain

[11] Patent Number: 5,293,962

[45] Date of Patent: Mar. 15, 1994

[54] FIREPROOF SHAFT DOOR FOR ELEVATORS

[75] Inventor: Jean-Claude Pelvilain, Ponthierry, France

[73] Assignee: Inventio AG, Hergiswil, Switzerland

[21] Appl. No.: 995,900

[22] Filed: Dec. 23, 1992

[30] Foreign Application Priority Data

Dec. 24, 1991 [CH] Switzerland ..... 03843/91-2

[51] Int. Cl.[5] ..... B66B 9/00

[52] U.S. Cl. ..... 187/1 R; 52/30; 49/120

[58] Field of Search ..... 187/1 R, 51; 52/30, 52/211, 212, 204, 731; 49/116, 120, 472

[56] References Cited

U.S. PATENT DOCUMENTS

| | | | |
|---|---|---|---|
| 3,631,942 | 1/1972 | Brounn | 187/1 R |
| 4,530,189 | 7/1985 | Randall | 52/30 |
| 4,700,809 | 10/1987 | Lazar | 187/1 R |
| 5,156,237 | 10/1992 | Hayashi et al. | 187/1 R |

FOREIGN PATENT DOCUMENTS 2610311 5/1988 France .

1522413 8/1978 United Kingdom .

*Primary Examiner*—D. Glenn Dayoan
*Assistant Examiner*—Kenneth Noland
*Attorney, Agent, or Firm*—William J. Clemens

[57] ABSTRACT

A fireproof shaft door for an elevator installation has an improved heat insulation towards the shaft side in the case of a fire at the floor side of the door. A door is filled with heat insulating spaces and heat insulating mat and is positioned at the floor side of a framework which is carried by a door suspension. The framework is horizontally displaceable on a roller and is guided at a lower edge by a sliding guide engaging a recess in a threshold. Horizontal spars, which are provided with ventilation apertures, are attached to the door box at the shaft side. Heat insulating plates are attached to the spares to cover the shaft side of the framework. A first hollow space is formed between the door box and the heat insulating plates and functions as natural chimney in which fresh air circulates. A vertically extending recess is formed in a closing edge of the door box to form a second hollow space in which fresh air circulates when the door is closed.

17 Claims, 2 Drawing Sheets

FIREPROOF SHAFT DOOR FOR ELEVATORS

BACKGROUND OF THE INVENTION

The present invention relates generally to elevator installations and, in particular, to a fireproof door for an elevator shaft.

The German patent document DE-A1 25 12 536 discloses a box-like elevator shaft door, in which cooling air feed openings are provided in the lower region of the metal door cover plate at the shaft side and cooling air outlet openings are provided in the upper region of the same. Thereby, the metal door cover plate at the lobby side is cooled uniformly and the metal door cover plate at the shaft side is protected against excess heating.

The French patent document FR-A1 2 610 311 discloses an elevator shaft door which has a frame and which serves as a carrier for a respective insulating panels arranged at the lobby side and at the shaft side. The frame itself is filled with an insulating mat. A fire resistance of two hours is achieved with this door construction.

A disadvantage of the known fireproof shaft doors is that they do not meet the more severe regulations of certain countries in respect of the permitted temperature gradient between the fire side and cool side.

SUMMARY OF THE INVENTION

The present invention concerns a fireproof shaft door for an elevator installation having an improved heat insulation towards the shaft side in the case of a fire at the floor side of the door. A door box is filled with heat insulating spaces and heat insulating mat and is positioned at the floor side of a framework which is carried by a door suspension. The framework is horizontally displaceable on a roller and is guided at a lower edge by a sliding guide engaging a recess in a threshold. Horizontal spars, which are provided with ventilation apertures, are attached to the door box at the shaft side. Heat insulating plates are attached to the spares to cover the shaft side of the framework. A first hollow space is formed between the door box and the heat insulating plates and functions as natural chimney in which fresh air circulates. A vertically extending recess is formed in a closing edge of the door box to form a second hollow space in which fresh air circulates when the door is closed. In an alternate embodiment, the spars can extend vertically.

The present invention solves the problem of the known fireproof doors and provides specified rigidity, fire resistance and heat insulation.

The advantage achieved by the present invention is that, in the case of fire at the lobby or floor side, the elevator shaft remains available to the fire service as an escape path due to the improved heat insulation at the shaft side. A further advantage is that, in spite of improved fire protection properties, the total weight of the shaft door can be kept small. Another advantage is that heat bridges between the heat insulating layers can be avoided to a large extent. Another advantage is that the usual fire protection sluices in front of the elevator doors at each floor are not necessary.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
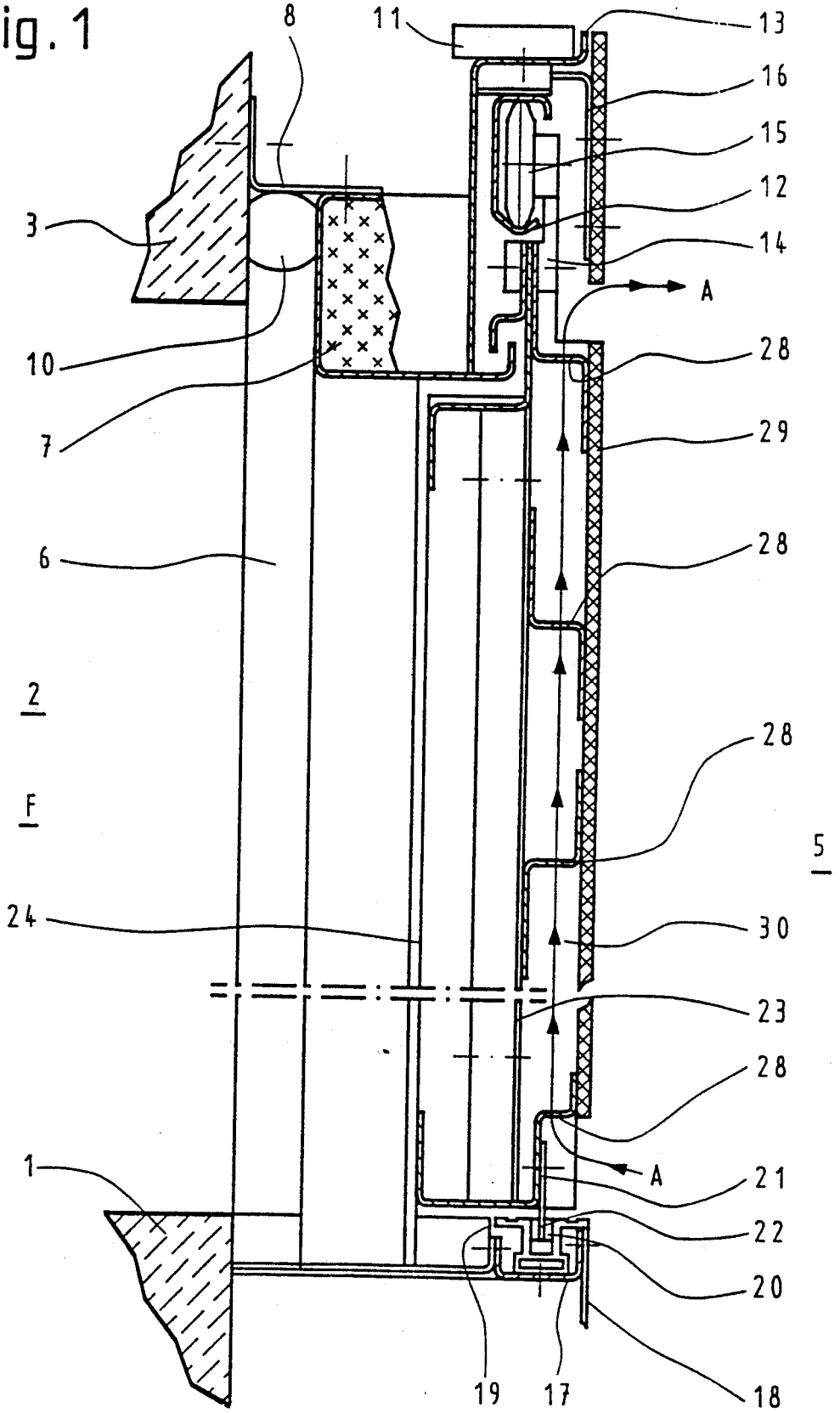
FIG. 1 is a side elevation view, in cross section, of an elevator shaft door according to the present invention.
Figure 2:
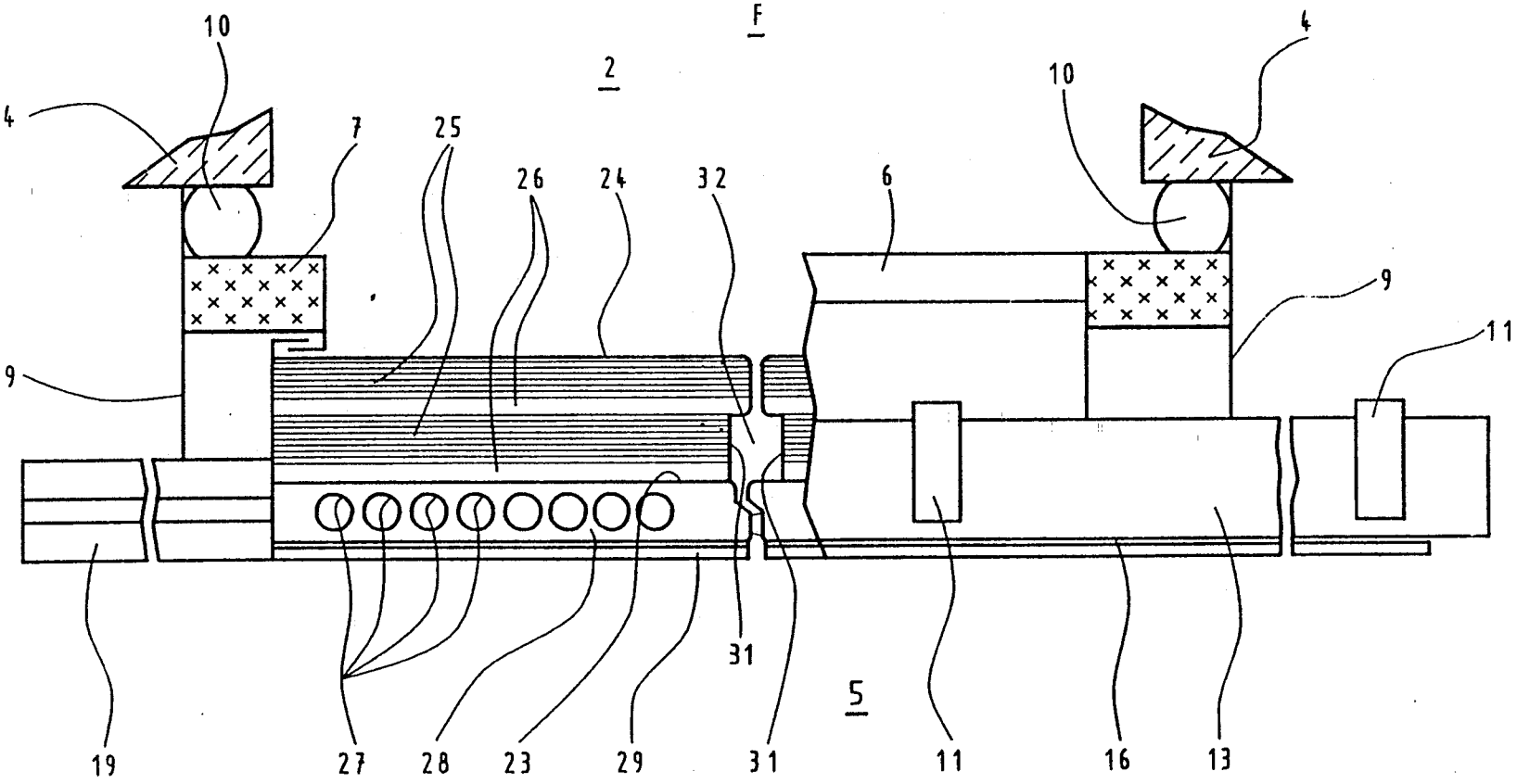
FIG. 2 is a top plan view, in cross section, of the elevator shaft door shown in the FIG. 1.

A fire can occur in an area F adjacent an elevator shaft door opening, the opening being bounded at a bottom edge by a floor 1 of a lobby 2, at an upper edge by a lintel beam 3 and laterally by a pair of spaced apart door posts 4 as shown in the FIGS. 1 and 2. The lintel beam 3 and the door posts 4 form a shaft opening of an elevator shaft 5 and are backed by a hollow door frame 6. The door frame 6 is filled with a heat insulating substance 7 and is attached to the lintel beam 3 by a horizontally extending flange 8 and to the door posts 4 by a pair of vertically extending flanges 9. In order to accommodate construction and mechanical deviations, a heat insulating sealing bead 10 is provided between the door frame 6 and the lintel beam 3 and between the door frame 6 and the door posts 4.

The upper horizontal portion of the door frame 6 is connected with a horizontally extending fastening rail 11. A roller guide 12 is attached to and extends downwardly from a transverse carrier 13. The carrier 13 has a lower end attached to the door frame 6 and extends upwardly toward the rail 11 to an upper end and then rearwardly toward the elevator shaft 5. The rearwardly extending portion of the carrier 13 is connected between the rail 11 and the roller guide 12. A door suspension 14 extends downwardly from a roller 15 which is positioned in the roller guide 12. A vertically extending cover 16, having a layer of heat insulating material attached to a rear surface thereof, spans the roller guide 12 and the door suspension 14 adjacent to the elevator shaft 5. The lower horizontal portion of the door frame 6 is terminated at the shaft 5 by a horizontally extending, U-shaped threshold carrier 17 having a vertically extending metal cover plate 18 attached to a rear leg thereof. Positioned in a groove formed in the threshold carrier 17 is a sliding guide 20. A vertically extending guide carrier 21 includes a guide blade 22 having an upper edge attached to a shaft door as explained below and a lower edge attached to the sliding guide 20.

A vertically extending framework 23 is attached along an upper edge thereof to and supported by the door suspension 14. A door box 24 is attached to the frame 23 on the lobby side or the fire side and, as illustrated in the FIG. 2, is filled with alternating heat insulating spaces 25 and heat insulating mats 26 in a layered sequence beginning at the lobby side with a space 25, then a mat 26, then a space 25, and then a mat 26. A plurality of horizontally extending spars 28, each having a plurality of ventilating apertures formed therein, are attached to a rear surface of the box 24. One of the spars 28 at the upper end of the box 24 is attached to the door suspension 14 and another one of the spars 28 at the lower end of the box 24 is attached to the upper edge of the guide blade 22. Thus, the framework 23 is guided in movement along the roller guide 12 by the guide 20 sliding in the threshold 19.

Attached to the spars 28 and facing the shaft 5 are heat insulating plates 29. In a variation or alternate embodiment, the spars 29 can extend vertically. A first hollow space 30 is bounded by the box 24 and the heat insulating plates 29. The space 30 acts as natural chimney, in which fresh air denoted by A circulates. The door box 24 is formed from two leaves which abut at vertically extending closing edges, each of the closing edges having a recess 31 formed therein. The recesses 31 are aligned with the spaces 25 closer to the shaft 5 and face one another to form a second hollow space 32 which serves as a chimney when the doors are closed.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A fireproof shaft door for an elevator installation, the shaft door being positioned at a floor in a shaft door opening in a wall of the shaft, the shaft door being suspended by a door suspension attached to a roller guided in a roller guide attached to the shaft wall, the shaft door being horizontally displaceable by movement of the roller along the roller guide, a lower edge of the shaft door being attached to and guided by a sliding guide in a threshold of the shaft door opening, comprising:

a framework having a floor side and a shaft side;

a door box positioned at said floor side of said framework and having an interior with a plurality of heat insulating spaces and heat insulating mats therein;

a plurality of spars attached to said door box at said shaft side of said framework; and a plurality of heat insulating plates attached to said spars at said shaft side of said framework whereby said heat insulating plates are spaced from and cooperate with said door box to form a first hollow space therebetween in which fresh air can circulate.

2. The fireproof shaft door according to claim 1 wherein said the spars extend horizontally and include a plurality of ventilation holes for circulating fresh air in said first hollow space.

3. the fireproof shaft door according to claim 2 wherein said door box has a vertically extending closing and including a vertically extending recess formed in said closing edge to form a second hollow space for circulating fresh air when the fireproof shaft door is in a closed position in the shaft door opening.

4. The fireproof shaft door according to claim 2 wherein said door box interior is filled with a first one of said heat insulating spaces, a first one of said heat insulating mats, a second one of said heat insulating spaces and a second one of said heat insulating mats in a layer sequence beginning at said floor side of said framework.

5. The fireproof shaft door according to claim 1 wherein said spars extend vertically.

6. The fireproof shaft door according to claim 5 wherein said door box has a vertically extending closing edge and including a vertically extending recess formed in said closing edge to form a second hollow space for circulating fresh air when the fireproof shaft door is in a closed position in the shaft door opening.

7. The fireproof shaft door according to claim 5 wherein said door box interior is filled with a first one of said heat insulating spaces, a first one of said heat insulating mats, a second one of said heat insulating spaces and a second one of said heat insulating mats in a layer sequence beginning at said floor side of said framework.

8. The fireproof shaft door according to claim 1 wherein said door box has a vertically extending closing edge and including a vertically extending recess formed in said closing edge to form a second hollow space for circulating fresh air when the fireproof shaft door is in a closed position in the shaft door opening.

9. The fireproof shaft door according to claim 1 wherein said door box interior is filled with a first one of said heat insulating spaces, a first one of said heat insulating mats, a second one of said heat insulating spaces and a second one of said heat insulating mats in a layer sequence beginning at said floor side of said framework.

10. A fireproof shaft door for an elevator installation, the shaft door being positioned at a floor in a shaft door opening in a wall of the shaft, the shaft door being suspended by a door suspension attached to a roller guided in a roller guide attached to the shaft wall, the shaft door being horizontally displaceable by movement of the roller along the roller guide, a lower edge of the shaft door being attached to and guided by a sliding guide in a threshold of the shaft door opening, comprising:

a framework having a floor side and a shaft side;

a door box positioned at said floor side of said framework and having an interior with a plurality of heat insulating spaces and heat insulating mats therein;

a plurality of spars attached to said door box at said shaft side of said framework;

a plurality of heat insulating plates attached to said spars at said shaft side of said framework whereby said heat insulating plates are spaced from and cooperate with said door box to form a first hollow space therebetween in which fresh air can circulate; and wherein said door box has a vertically extending closing edge and including a vertically extending recess formed in said closing edge to form a second hollow space for circulating fresh air when the fireproof shaft door is in a closed position in the shaft door opening.

11. The fireproof shaft door according to claim 10 wherein said the spars extend horizontally and include a plurality of ventilation holes for circulating fresh air in said first hollow space.

12. The fireproof shaft door according to claim 11 wherein said door box interior is filled with a first one of said heat insulating spaces, a first one of said heat insulating mats, a second one of said heat insulating spaces and a second one of said heat insulating mats in a layer sequence beginning at said floor side of said framework.

13. The fireproof shaft door according to claim 10 wherein said spars extend vertically.

14. The fireproof shaft door according to claim 13 wherein said door box interior is filled with a first one of said heat insulating spaces, a first one of said heat insulating mats, a second one of said heat insulating spaces and a second one of said heat insulating mats in a layer sequence beginning at said floor side of said framework.

15. A fireproof shaft door for an elevator installation, the shaft door being positioned at a floor in a shaft door opening in a wall of the shaft, the shaft door being suspended by a door suspension attached to a roller guide attached to the shaft wall, the shaft door being horizontally displaceable by movement of the roller along the roller guide, a lower edge of the shaft door being attached to and guided by a sliding guide in a threshold of the shaft door opening, comprising:

a framework having a floor side and a shaft side;

a door box positioned at said floor side of said frame work and having an interior filled with a first heat insulating space, a first heat insulating mat, a second heat insulating space and a second heat insulating mat in a layer sequence beginning at said floor side of said framework;

a plurality of spars attached to said door box at said shaft side framework;

a plurality of heat insulating plates attached to said spars at said shaft side of said framework whereby said heat insulating plates are spaced from and cooperate with said door box to form a first hollow space therebetween in which fresh air can circulate; and wherein said door box has a vertically extending closing edge and including a vertically extending recess formed in said closing edge to form a second hollow space for circulating fresh air when the fireproof shaft door is in a closed position in the shaft door opening.

16. The fireproof shaft door according to claim 15 wherein said the spars extend horizontally and include a plurality of ventilation holes for circulating fresh air in said first hollow space.

17. The fireproof shaft door according to claim 15 wherein said spars extend vertically.

* * * * *